US005240017A

United States Patent [19]

Terwilliger

[11] Patent Number: 5,240,017

[45] Date of Patent: Aug. 31, 1993

[54] BRAIDING COMB

[76] Inventor: Gary M. Terwilliger, 1501-57 Popps Ferry Rd., Biloxi, Miss. 39532

[21] Appl. No.: 908,221

[22] Filed: Jul. 2, 1992

[51] Int. Cl.[5] ..... A45D 24/38

[52] U.S. Cl. ..... 132/145; 132/124; 132/144

[58] Field of Search ..... 132/124, 144, 145, 146, 132/148, 219

[56] References Cited

U.S. PATENT DOCUMENTS

| | | | |
|---|---|---|---|
| D. 103,302 | 2/1937 | Brady | 132/148 |
| D. 137,321 | 2/1944 | Nussbaum | 132/146 |
| 1,359,343 | 11/1920 | Dodge | 132/124 |
| 1,609,208 | 11/1926 | Schneeberger et al. | 132/144 |
| 2,005,187 | 6/1935 | Halloh | 132/145 |
| 2,288,156 | 6/1942 | Dove | 132/124 |
| 2,333,326 | 11/1943 | Maier | 132/148 |
| 2,345,339 | 3/1944 | Hodaly | 132/148 |
| 2,551,472 | 5/1951 | Sonderegger | 132/149 |
| 2,587,389 | 2/1952 | Scheithe | 132/124 |
| 2,616,435 | 11/1952 | Lupo | 132/148 |
| 3,042,048 | 7/1962 | Mostik | 132/149 |
| 3,166,081 | 1/1965 | Larson et al. | 132/124 |
| 3,368,569 | 2/1968 | Lawrence | 132/124 |
| 3,529,609 | 9/1970 | Rodriguez | 132/148 |
| 4,026,307 | 5/1977 | Morrow | 132/148 |
| 4,108,186 | 8/1978 | Esposto | 132/14 |

FOREIGN PATENT DOCUMENTS

| | | | |
|---|---|---|---|
| 303706 | 1/1929 | United Kingdom | 132/148 |
| 603887 | 6/1948 | United Kingdom | 132/148 |

*Primary Examiner*—Robert P. Swiatek
*Assistant Examiner*—Frank A. LaViola
*Attorney, Agent, or Firm*—Alexander Norcross

[57] ABSTRACT

The invention shows a comb for the formation of braids and similar hairstyles in professional hairdressing. One embodiment is a comb, having teeth of a spaced pattern common in the trade; extending out from the back of the comb, for a substantial distance along the back of the comb is a flat, flexible bar, spaced a distance from the comb. Preferably, the spacing is tapered, being narrower at the point of attachment of the bar to the comb. This forms a tapered space for holding a section of hair, and aids in retaining the section of hair by the comb, permitting a hairdresser to separate a section of hair into the space, and then allow the comb to hang free. In a second version of the comb, the flexible bar is in the form of a spring, a curved flexible bar fastened to one end of the comb, and extending in for form of a looped curve along the back to a pivot pin at the other end of the comb; the bar then is curved around the pin and extends back a distance along the comb to form the hair braid retention space. A clamp rides over the curve of the flexible bar. Movement of the clamp moves the extension closer to or away from the back of the comb, adjusting the spacing of the bar.

5 Claims, 2 Drawing Sheets

BRAIDING COMB

BACKGROUND OF THE INVENTION

This patent is related to the field of hairdresser's combs, particularly combs for braiding and dressing hairstyles. Patents which show extensions affixed to combs include:

U.S. Pat. No. 2,616,435 to Lupo shows a comb having a curved hooked tooth for separating and for curling hair. The drawing and the claim are to a tooth, integral with one end of the comb, and curving to the opposite end.

U.S. Pat. No. 3,696,823 to Dannat shows a different structure for combining a hair sectioner with a comb.

U.S. Pat. No. 4,605,020 to Lavoie shows a curved back handle with a hand grip to ease manipulation. Note that the grip must fit within the hand, while the comb is outside the hand (see FIG. 2).

U.S. Pat. No. 2,551,472 to Sonderegger is an earlier patent showing a curved hand grip extending out of the back of the comb.

U.S. Pat. No. 3,042,048 to Mostik shows a hand grip which is curved, but which does not fold back along the body of the comb.

DES 261,939 to Nevarez shows a comb with a handle extension extending in the direction of the other teeth, but offset at an angle to the plane of the comb.

DES 192,201 to Rolls shows a spine or ridge extending from the back of a comb.

DES 162,962 to Killinger shows an alternate offset handle.

No hair comb exists which permits easy, two handed manipulation of multiple strands of hair for braiding. A hairdresser, faced with the task of braiding hair, must comb out multiple sections of hair, secure each section and, form the braids by hand, maintaining each section separate. This now requires multiple actions, picking up and putting down combs, and separately handling clips or other devices for maintaining the braid sections separate. These repeated hand actions must be performed for each twist in the braid, and significantly add to the labor of braiding hair.

SUMMARY OF THE INVENTION

The invention shows an inventive comb of particular utility for the formation of braids and similar hairstyles in professional hairdressing. The basic form of the invention is a comb, having teeth of a spaced pattern common in the trade; extending out from the back of the comb for a substantial distance along the back of the comb is a flat flexible bar, spaced a distance from the comb sufficient to separate and hold a braidable hair section.

Typically, such spacing would average one fourth inch. Preferably, the spacing is tapered, being greater at the end of the bar than at the point of attachment of the bar to the back of the comb. This forms a tapered space for holding a section of hair, and aids in retaining the section of hair by the comb; this permits the hairdresser to separate a section into the space, and then allow the comb to hang free, holding the first section separate while the hairdresser's hands are free to separate two other sections of hair, thus the comb allows a hairdresser to easily manage and braid more sections of hair than can be held only by the hands.

In a second version of the comb, the flexible bar is in the form of a spring bar, a curved flexible bar fastened to one end of the comb, and extending in for form of a looped curve along the back to a pivot pin at the other end of the comb; the bar then is curved around the pin and extends back a distance along the comb to form the hair braid retention space. A clamp slidably fixed to the back of the comb rides over the curve of the flexible bar. Movement of the clamp along the back of the comb presses down on the curve of the bar, and moves the extension closer to or away from the back of the comb, thus adjusting the spacing of the bar and the comb to retain a braid section of hair.

It is an object of the invention to disclose a device which combines in one unit a braid selection hook, a comb for straightening hair, and a device for holding the selected hair section apart while other sections are twisted by hand into a braid.

It is a further object of the invention to disclose a braiding comb which retains a braid section of hair separate without additional clamps or clips.

It is a further object of the invention to disclose an apparatus for combing and braiding hair which may be retained in the hair, eliminating the separate manipulation of multiple devices while braiding hair.

Other advantages of the invention may be seen from the detailed description below.

DETAILED DESCRIPTION OF THE INVENTION

Figure 3:
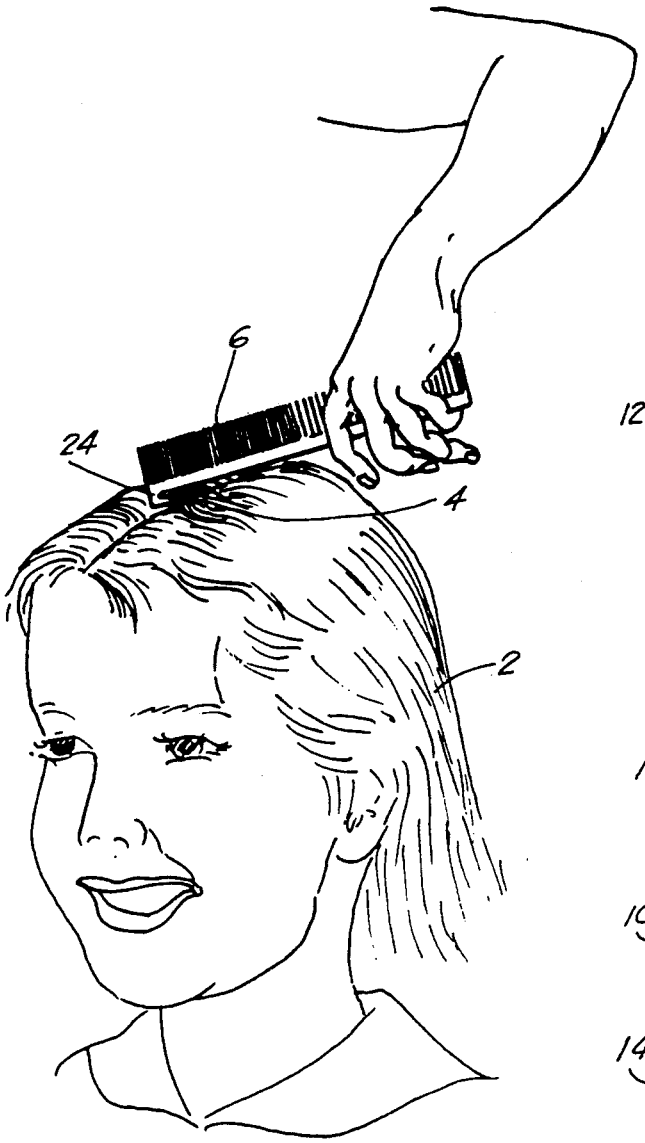
FIG. 3 shows the use of the invention to gather a braiding section of hair.
Figure 2:
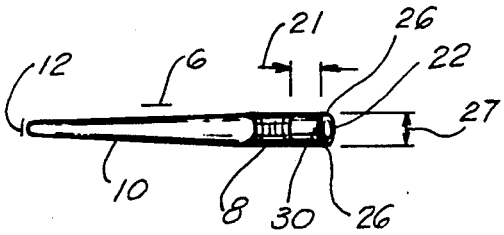
FIG. 2 shows an end view of the embodiment of FIG. 1.
Figure 1:
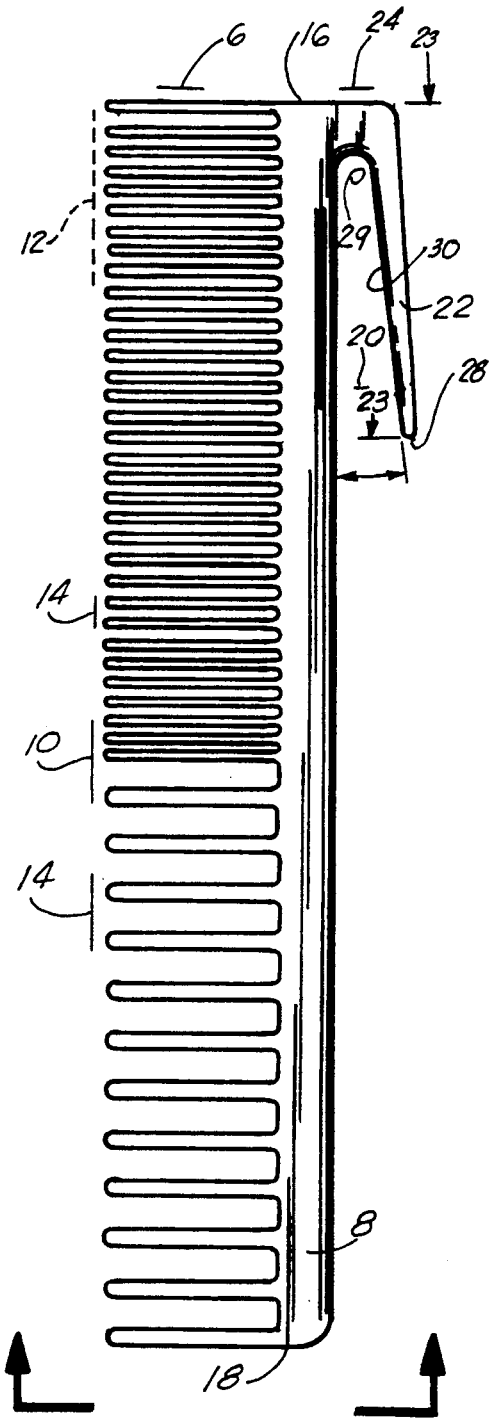
FIG. 1 shows a side view of one embodiment of the invention.
Figure 7:
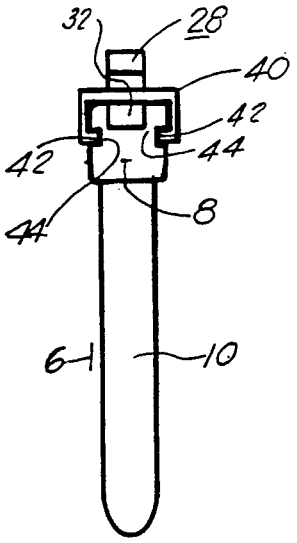
FIG. 7 shows an end view of the second embodiment of the invention.
Figure 4:
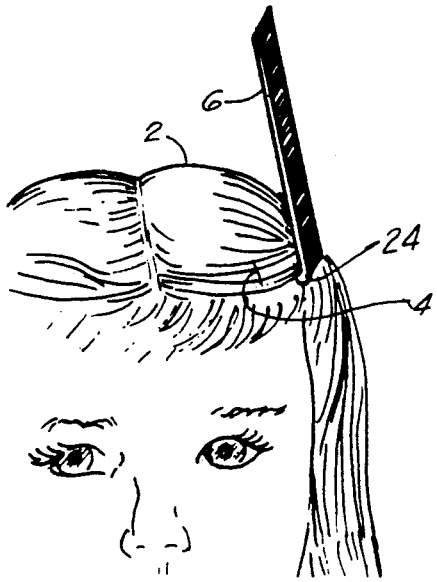
FIG. 4 shows the comb of the invention supported in place, holding the chosen section of hair.
Figure 5:
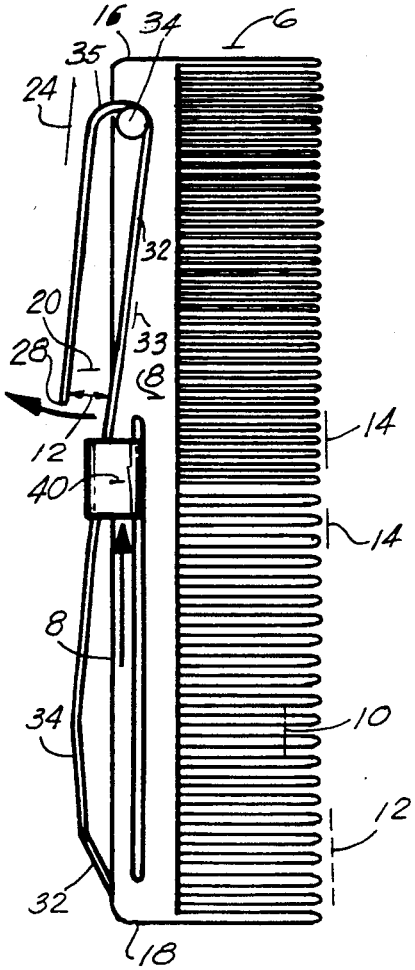
FIG. 5 shows a side view of a second embodiment of the invention, with opened braiding selection space.
Figure 6:
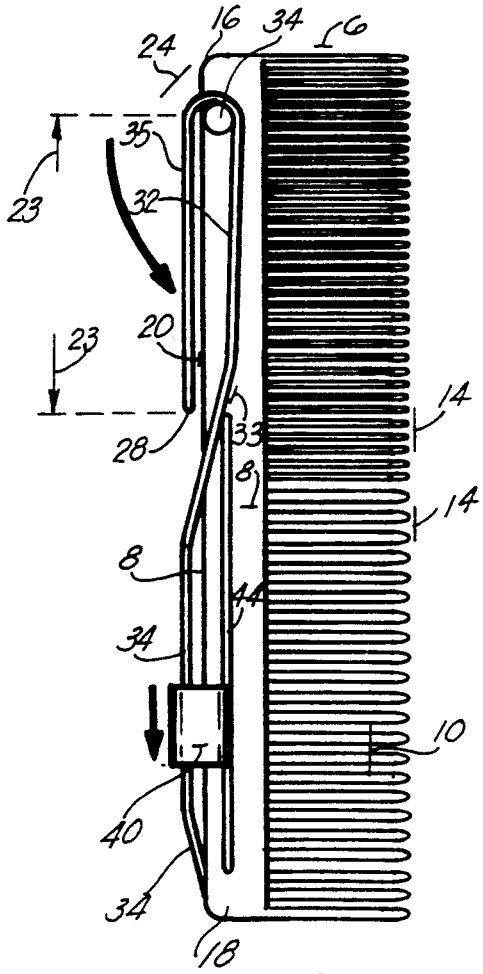
FIG. 6 shows a side view of a second embodiment of the invention, with closed braiding selection space.

As is known to the art of Hair dressing, various styles of hair dressing include the requirement to form braids in a person's hair. There are a number of such styles, but all involve the separation of the hair 2 to be braided into sections 4, which are combed straight, and the sections 4, thus parted and formed, are braided into a pleasing pattern. Most such styles involve more than two parted sections 4 of hair 2, and thus present the problem to the hair dresser of maintaining the parted sections 4 apart, while handling, combing and braiding them.

The invention is a hair dresser's comb 6 of an improved type for assisting in the formation of hair braids. The comb is based on a standard hair dresser's comb, with a straight back or spine 8, and a plurality of rounded teeth 10 in a spaced pattern. These teeth 10 define the front 12 of the comb; the spine 8 of the comb 6, to which the teeth 10 are attached for support, forms the back 8 of the comb 6. Typically the teeth 10 are provided in several adjacent sections 14, each having differing tooth to tooth spacings, and each having a particular utility for a combing task.

In the invention, a braiding separation space 20 is formed by an attached spaced flat flexible bar 22 which is attached to the back 8 of the comb 6 at one end 16 of the comb. The bar 22 is spaced from the back 8 of the comb by a distance 21, typically averaging one fourth inch. The bar 22 extends along the back 8 of the comb for a substantial distance 23, usually from one fourth to one third of the overall length 25 of the comb 6. In appearance, the bar 22 forms, with the comb 6, a braiding hook 24.

The bar 22 is of a generally flat shape, having rounded edges 26, and defines a braid containing space 20 between the bar 22 and the comb 6. The flat shape of the bar 22, in conjunction with the thickness 27 of the back 8 presents a smooth surface 30 to any hair sections 4 held within the containing space 20. It is preferred to taper the containing space 20 creating a narrower space 29 near the end 16 of the comb 6 than near the outer end 28 of the bar 22.

In use, the hairdresser combs a person's hair 2, selecting an amount for a parted section 4 for braiding. The comb 6 is reversed, and drawn along the selection 4, which is thus captured within the containing space 20. The closed taper of the containing space 20 helps capture and hold the hair 2; the flat shape of the bar 22 prevents this capture from crimping or damaging the hair 2. The hair 2 is well enough held that the reversed comb 6 can be released, and will hold in the hair 2, keeping the selected part 4 of hair separated, yet without tangling, while the hair dresser's hands are free to select other parts for braiding.

Manipulation of the comb 6 and the hands thus permits the formation of multi-part braids is a quick and easy fashion, without the need for temporary clamps or other accessories.

In an alternate form of the invention, the comb 6 has, attached to the spine 8 at one end 18, a flexible flat bar 32, curved in an arch 34 over and along the spine 8, along the comb 6. The spine 8 of the comb is grooved so that the flat bar 32 can be bent down 33 below the level of the back 8 of the comb 6. The bar 32 is curved, and passes around a pivot pin or retainer 34 in the other end 16 of the spine 8 of the comb 6; the bar 32 is then folded back 35 along the comb back 8 to form the containing space 20 above described.

A clamp 40, of a folded plastic or metal shape, is attached to the back 8 of the comb 6 by setting the lower ends 42 of the clamp 40 into parallel grooves 44 in the spine 8 so that the clamp 40 may be slid along the back 8 of the comb 6. The clamp 40 covers the spine 8 of the comb so that it rides over the curved arch 34 of the flexible bar 32. Sliding the clamp 40 along the back 8 of the comb thus forces the flexible bar 32 down into the spine 8 of the comb 6; this twists the bar 32 around the pivot point 34, causing the end 28 of the bar 32 to move closer to the back 8 of the comb or away from the comb 6 depending on the positioning of the clamp 40.

In use this alternate form of the comb 6 is used in a similar fashion to the first embodiment, except that the hair dresser can cause the comb 6 to clamp to or release the selected part 4 of hair 2 by sliding the clamp 40 along the spine 8 of the comb. The hairdresser can thus with a single handed motion, comb the hair 2, separate out a part 4, capture the part 4 within the containing space 20 and then close the comb 6 onto the selected part 4 by sliding the clamp 40 along the comb to lower the bar end 28 against the back 8 of the comb 6. Since clamp 40 is formed as a symmetrical, inverted U shaped section riding in grooves 44 on both sides of the back 8 of the comb, the clamp 40 may be slid by easy thumb motions whether the comb is held in the left hand or the right hand.

It can thus be seen that the invention as claimed provides a more easy preparation of the hair for braiding and for braiding the hair, eliminating any requirement for separate clamps or hairpins during the braiding process. Further, as the inventive braiding hook 24 formed by the flat flexible bar 22, 32 both holds the parted hair 4 separate and holds the comb 6 in the hair 2 by the parted hair section 4, it is no longer necessary to repeatedly pick up and put down the comb 6 during braiding in order to manipulate the hair. The invention thus considerably simplifies the hair dresser's task in forming braids in hair.

It can thus be seen that the invention extends beyond the embodiments described as examples to a wider range of equivalents as are inherent in the claims.

I claim:

1. A braiding comb for use on the hair of a person comprising:

a comb having a back, and outwardly extending teeth, defining a front direction thereof;

an elongate flexible bar, having a flattened cross section, extending out of the back of said comb at one end thereof, said bar extending along the back of said comb towards the other end thereof in a slight curve, said bar being bent around a pivot pin at said other end of said comb forming an extension in reversed direction, spaced a distance from said comb sufficient to contain a braid section of hair, said extension spaced a distance defining a space which holds and separates said braid section separate from the person's hair, said space being shaped such that said comb may be held against the hair by the retention of the braid section in the space.

2. The comb of claim 1 further comprising:

a sliding clamp slidable affixed to the back of said comb, said clamp enclosing said flexible bar, clamping said flexible bar into said back, such that said extension is moved towards and away from said back as said clamp is slid along said comb back.

3. The comb of claim 1, said bar extension extending for a distance between one-forth to one-third of the length of said back.

4. The comb of claim 1, said bar extension being spaced from said back for a distance averaging about one-fourth inch.

5. The comb of claim 1, said bar being space a distance from said back which increases from the point of connection to said back to the end of the bar.

* * * * *